US006364039B1

(12) United States Patent
Majkovic

(10) Patent No.: US 6,364,039 B1
(45) Date of Patent: Apr. 2, 2002

(54) VIBRATION DAMPING TOOL

(75) Inventor: Davor Majkovic, Edmonton (CA)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/560,762

(22) Filed: Apr. 28, 2000

(51) Int. Cl.[7] ..... E21B 17/16
(52) U.S. Cl. ..... 175/320; 188/378; 464/20
(58) Field of Search ..... 175/320; 464/18, 464/20; 188/378

(56) References Cited

U.S. PATENT DOCUMENTS

| | | | | |
|---|---|---|---|---|
| 3,265,091 A | | 8/1966 | De Jarnett | 138/114 |
| 3,842,942 A | * | 10/1974 | Jensen et al. | 299/94 |
| 3,923,414 A | * | 12/1975 | Hopkins | 408/143 |
| 3,947,008 A | | 3/1976 | Mullins | 267/137 |
| 4,139,994 A | * | 2/1979 | Alther | 175/321 |
| 4,439,167 A | | 3/1984 | Bishop et al. | 464/20 |
| 4,522,271 A | * | 6/1985 | Bodine et al. | 175/320 |
| 4,844,181 A | | 7/1989 | Bassinger | 175/195 |
| 4,901,806 A | | 2/1990 | Forrest | 175/321 |
| 4,997,048 A | | 3/1991 | Isom | 175/323 |

* cited by examiner

*Primary Examiner*—William Neuder
(74) *Attorney, Agent, or Firm*—Rosenthal & Osha L.L.P.

(57) ABSTRACT

A vibration damping apparatus including an annular housing, a cavity between an internal diameter and an external diameter of the housing, and a substantially solid vibration damping material disposed in the cavity. The vibration damping material has a density that is greater than a density of the housing material. In one embodiment of the invention, the internal diameter and the external diameter of the housing are selected so as to maximize an amount of vibration damping material with respect to a selected tensile strength for the housing. In another embodiment of the invention, the internal diameter and the external diameter of the housing are selected so as to maximize an amount of vibration damping material with respect to a selected bending strength for the housing.

46 Claims, 2 Drawing Sheets

VIBRATION DAMPING TOOL

BACKGROUND OF THE INVENTION

1. Technical Field

The invention relates generally to vibration damping apparatus. More specifically, the invention relates to a vibration damping apparatus used to damp vibrations produced when drilling a well.

2. Background Art

Typically, drilling systems used by the oil and gas industry to drill wells in earth formations include a drilling rig used to turn a drill string which extends downward into a wellbore. Connected to the end of the drill string is a bottom hole assembly ("BHA") that may include, for example, a drill bit, a positive displacement motor, measurement while drilling ("MWD") tools, and logging while drilling ("LWD") tools, among other tools.

Drilling activity typically involves applying an axial load to the drill bit when the bit is in contact with the formation at the bottom of the wellbore, while rotating the bit. When the bit drills the formation, it produces vibrations and oscillations of the BHA and of drillpipe located above the BHA. These vibrations and oscillations are undesirable because they may cause fatigue and, ultimately, structural failure of elements of the BHA, the drillpipe, or the drill bit. Moreover, the vibrations may have damaging effects on electronic instrumentation present in the MWD and LWD tools.

Many efforts have been made to design mechanical devices to reduce oscillations, shocks, and vibrations. Some of the devices use reciprocating mandrels in combination with a compressible fluid filled chamber to absorb shocks and dampen vibrations, such as the device disclosed in U.S. Pat. No. 4,439,167 issued to Bishop et. al. Other devices use a plurality of resilient elastomer elements or belleville springs to absorb axial shocks, such as the floating sub disclosed in U.S. Pat. No. 4,844,181 issued to Bassinger. Another class of devices uses floating pistons and compressible fluid filled chambers to absorb axial vibrations, such as the device disclosed in U.S. Pat. No. 4,901,806 issued to Forrest. Another class of devices uses a helically splined mandrel or annular springs to absorb vibrations, such as the drill string shock absorber disclosed in U.S. Pat. No. 3,947,008 issued to Mullins. U.S. Pat. No. 3,265,091 issued to De Jarnett discloses another device for absorbing vibrations that includes a drill pipe having an inner steel tube and an outer steel tube. The annular space between the tubes is filled with a fluid of preselected density that acts to damp or absorb vibrations.

SUMMARY OF THE INVENTION

One aspect of the invention is a vibration damping apparatus including an annular housing, a cavity between an internal diameter and an external diameter of the housing, and a substantially solid vibration damping material disposed in the cavity. The substantially solid vibration damping material has a density that is greater than a density of a material from which the housing is formed.

In another aspect of the invention, the internal diameter and the external diameter of the housing are selected so as to maximize an amount of vibration damping material with respect to a selected tensile strength for the housing.

In another aspect of the invention, the internal diameter and the external diameter of the housing are selected so as to maximize an amount of vibration damping material with respect to a selected bending strength for the housing.

Other aspects and advantages of the invention will be apparent from the following description and the appended claims.

DETAILED DESCRIPTION

Figure 1:
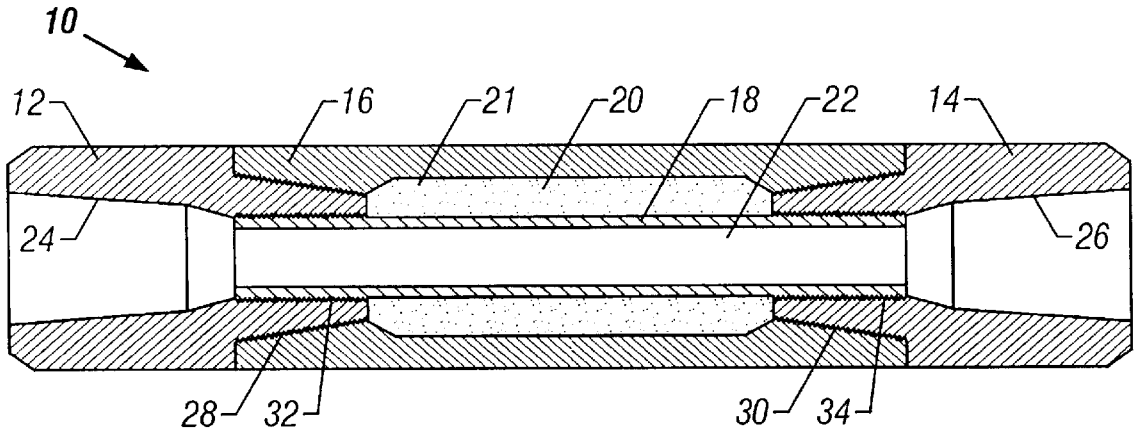
FIG. 1 shows a cross sectional view of an embodiment of the invention.

FIG. 1 shows an embodiment of a vibration damping apparatus 10 including an upper housing 12, a lower housing 14, and an intermediate housing 16. An inner housing 18 is connected to the upper housing 12 at connection 32, and is connected to the lower housing 14 at connection 34. The connections 32 and 34 may be threaded connections. Alternatively, the connections 32 and 34 may be made by any means known in the art such, as splined connections or welded connections. The type of connection used is not intended to limit the scope of the invention.

The upper housing 12 connects to the intermediate housing 16 at connection 28 while the lower housing 14 connects to the intermediate housing 16 at connection 30. Similar to connections 32 and 34, connections 28 and 30 may be threaded connections or may be any other type of connection known in the art. The upper housing 12 and the lower housing 14 are adapted to be connected to a drillstring (not shown) by connections 24 and 26, respectively. Connections 24 and 26 are typically threaded connections. All of the connections (24, 26, 32, and 34) in this embodiment are adapted to form fluid-tight seals. The inner diameter (D3 in FIG. 2) of the inner housing 18 defines a bore 22 for the passage of drilling fluid to the bottom of a wellbore (not shown).

Figure 2:
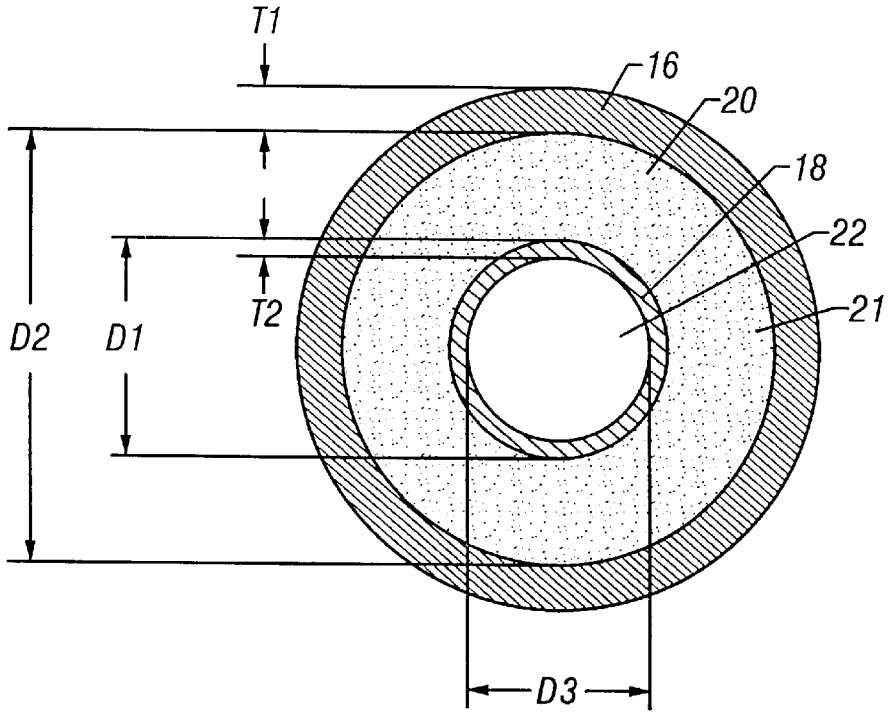
FIG. 2 shows a cross sectional view of an embodiment of the invention.

Referring to FIG. 1 and the cross section shown in FIG. 2, when the housings (12, 14, 16, and 18) are assembled, they form an annular cavity 20 located between an outer diameter (D1 in FIG. 2) of the inner housing 18 and an inner diameter (D2 in FIG. 2) of the intermediate housing 16. The cavity 20 is filled with a substantially solid vibration damping material 21 that has a density that is greater than a density of a material from which the housings (12, 14, 16, and 18) are formed. For example, the vibration damping material 21 may include crushed tungsten carbide particles. In one embodiment of the invention, the crushed tungsten carbide has a 30/40 mesh. However, the crushed tungsten carbide may have a different particle size and still function within the scope of the invention.

The vibration damping material 21 may also include lead. Moreover, the vibration damping material 21 may be a combination of crushed tungsten carbide and lead. Compositional properties, such as volume fractions of the tungsten carbide and the lead, may be calculated, for example, through laboratory testing and/or through computational modeling of the vibration damping apparatus 10. The vibration damping material 21 composition may be optimized by laboratory experiment or by modeling to maximize a vibration absorption capacity of the vibration damping apparatus 10.

Material properties of the housings (12, 14, 16, and 18) and the vibration damping material 21 are important to the function of the invention. The housings (12, 14, 16, and 18)

are typically made of high tensile strength steel. However, the housings (12, 14, 16, and 18) may be made of any material with sufficient structural strength to withstand the forces encountered when drilling a wellbore. For example, the housings (12, 14, 16, and 18) may be made of titanium. The housings (12, 14, 16, and 18) may also be made of monel. Moreover, the housings (12, 14, 16, and 18) need not all be made from the same material.

Metals and their alloys are good conductors of acoustic energy. In contrast, the vibration damping material 21 serves as an insulator that does not readily transmit vibrations. For example, desirable material properties for the vibration damping material 21 include substantially reduced elastic properties (e.g., a relatively low elastic modulus), substantially low structural damping coefficients, and substantially high densities as compared to the material from which the housings (12,14,16, and 18) are made. Materials having these properties tend to absorb or damp the transmission of acoustic energy in the drillstring. However, other material properties may be considered and optimized to maximize the efficiency of the vibration damping apparatus 10.

In an exemplary embodiment of the invention, the housings (12, 14, 16, and 18) are made of AISI 4145 steel and the vibration damping material 21 is crushed tungsten carbide with a 30/40 mesh. The exemplary embodiment of the invention has been shown through testing to absorb approximately 42 percent of acoustic energy imparted to the vibration damping apparatus 10.

Referring again to FIG. 2, the cross sectional area of the cavity 20 may be optimized to provide a strong, stable, and relatively stiff structure that may withstand the high loads exerted on drilling assemblies. For example, a thickness T1 of the intermediate housing 16 and a thickness T2 of the inner housing 18 may be optimized to maximize the strength of the vibration damping apparatus 10. Furthermore, the thicknesses T1 and T2 may be optimized to maximize the cross sectional area of the cavity 20 so that the amount of vibration damping material 21 is maximized for any selected diameters D2 and D3. Methods for optimizing the dimensions and thicknesses to achieve selected mechanical properties are known in the art.

Moreover, the thickness T2 of the inner housing 18 should also be selected so that flow through the bore 22 in the inner housing 18, defined by diameter D3, is maintained at an acceptable level to prevent erosion and to maintain a selected pressure drop at any selected flow velocity. How to determine acceptable flow velocities and pressure drops for flow through the inner diameter of a housing is known in the art, and may help determine boundary values for the dimensions of the vibration damping apparatus 10. Similar boundaries exist for the determination of the outer diameter D2 of the intermediate housing 16. For example, the outer diameter D2 should be large enough so that the thickness T1 is sufficient to withstand high tensile loads. The diameters (D1, D2, and D3) and the thicknesses (T1 and T2) should also be selected so that the vibration damping apparatus 10 can flex sufficiently to pass through a "dogleg" or curve in a wellbore. By optimizing the diameters (D1, D2, and D3) and the thicknesses (T1 and T2), the cross sectional area of the cavity 20 can be optimized to maintain a selected tensile strength and/or a selected bending strength while maximizing the amount of vibration damping material 21 in the cavity 20.

The vibration damping apparatus 10 may be positioned in a drilling assembly or a drillstring to absorb and damp vibrations. The exact location of the vibration damping apparatus 10 in the drillstring may vary. In one example, the vibration damping apparatus 10 is positioned near the drill bit. In another example, the vibration damping apparatus 10 is positioned near the MWD or LWD elements of a BHA so that vibrations are damped before reaching electronic components. Moreover, more than one vibration damping apparatus 10 may be included in the same drillstring or BHA so that vibrations are further damped or are damped in stages. The location of the vibration damping apparatus 10 may also be selected to damp harmonic oscillations excited by the bit. The location of the vibration damping apparatus 10 in the drillstring is not intended to limit the scope of the invention.

Figure 3:
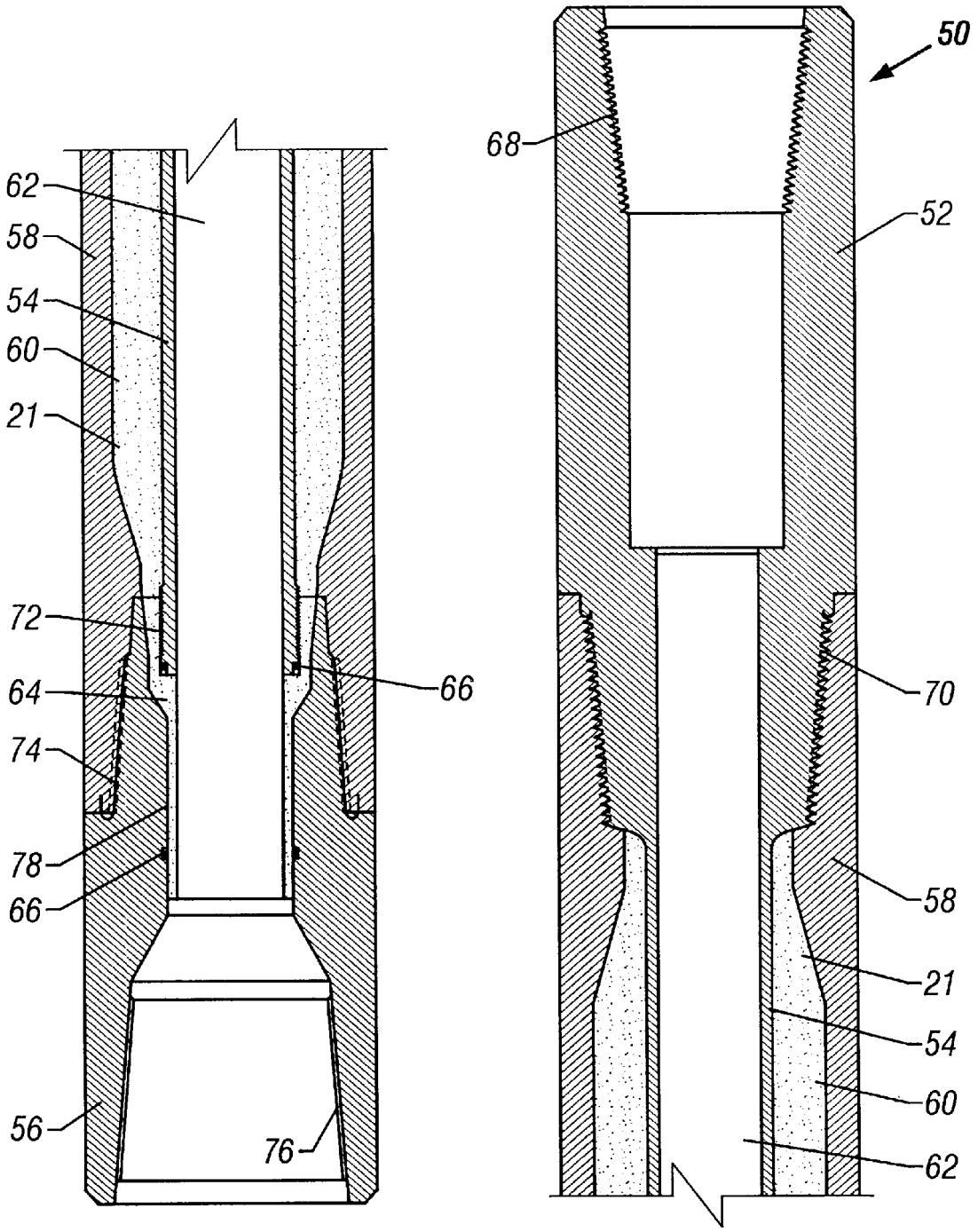
FIG. 3 shows a cross sectional view of an embodiment of the invention.

FIG. 3 shows another embodiment of a vibration damping apparatus 50. The vibration damping apparatus 50 includes an upper housing 52 and a lower housing 56. The upper housing 52 and lower housing 56 are adapted to connect with other elements of a drillstring (not shown) through connections 68 and 76, respectively. The apparatus further includes an intermediate housing 58 and a sleeve 64. The upper housing 52 has an extended section 54 that protrudes from the upper housing 52 and extends towards the lower housing 56. The extended section 54 has a bore 62 for the passage of drilling fluid through the apparatus 50.

The upper housing 52, the lower housing 56, the intermediate housing 58, and the sleeve 64 are all adapted to assemble and form the vibration damping apparatus 50. The upper housing 52 and the lower housing 56 engage the intermediate housing 58 at connections 70 and 74, respectively. The extended section 54 is adapted to connect to the sleeve 64 at connection 72, and the sleeve 64 engages the lower housing 56 at surface 78. The sleeve 64 engagement with the lower housing 56 at surface 78 is shown in FIG. 3 to be a slidable engagement. However, the sleeve 78 may engage the lower housing 56 by any means known in the art, such as a welded or splined connection. Moreover, all other connections in FIG. 3 are shown to be threaded connections, but any other connection means is acceptable within the scope of the invention. All of the connections are adapted to form fluid-tight seals, and the sleeve 64 is further sealed with respect to the extended section 54 and the lower housing 56 with elastomer seals 66.

The assembled vibration damping apparatus 50 forms a cavity 60 that is similar to the cavity 20 shown in FIGS. 1 and 2. The cavity 60 may likewise be filled with vibration damping material 21 so that the vibration damping apparatus 50 acts to damp the vibrations in a drilling assembly. Moreover, as in the embodiment of FIGS. 1 and 2, thicknesses of the housings (52, 54, 56, and 58) may be selected to optimize the structural properties and the vibration absorption properties of the vibration damping apparatus 50.

Advantageously, the vibration damping apparatus of the invention provides a mechanism for damping and reducing the vibrations in a drillstring or bottom hole assembly. The reduction in vibrations and shocks may help prevent structural fatigue and may increase the useful life of the drilling assembly. Moreover, the reduction in vibrations may also increase the life of a drill bit and prevent damage to MWD and LWD electronics.

Those skilled in the art will appreciate that other embodiments of the invention can be devised which do not depart from the spirit of the invention as disclosed herein. Accordingly, the scope of the invention should be limited only by the attached claims.

What is claimed is:

1. A vibration damping apparatus comprising:

an annular housing defining a fluid tight cavity between an internal diameter and an external diameter of the housing; and a substantially solid vibration damping material disposed in the fluid tight cavity, the material having a density that is greater than a density of material from which the housing is formed.

2. The apparatus of claim 1, wherein the housing is adapted to be connected to a downhole drilling assembly.

3. The apparatus of claim 2, wherein the housing is located between a drill bit and a drillstring.

4. The apparatus of claim 1, wherein the vibration damping material comprises crushed tungsten carbide.

5. The apparatus of claim 4, wherein the crushed tungsten carbide has a 30/40 mesh.

6. The apparatus of claim 1, wherein the vibration damping material comprises lead.

7. The apparatus of claim 1, wherein the internal diameter and the external diameter of the housing are selected so as to maximize an amount of vibration damping material with respect to a selected tensile strength for the housing.

8. The apparatus of claim 1, wherein the internal diameter and the external diameter of the housing are selected so as to maximize an amount of vibration damping material with respect to a selected bending strength for the housing.

9. The apparatus of claim 1, wherein the housing material comprises steel.

10. The apparatus of claim 1, wherein the housing material comprises titanium.

11. The apparatus of claim 1, wherein the housing material comprises monel.

12. The apparatus of claim 1, wherein an elastic modulus of the vibration damping material is substantially less than an elastic modulus of the housing material.

13. The apparatus of claim 1, wherein a structural damping coefficient of the vibration damping material is substantially less than a structural damping coefficient of the housing material.

14. The apparatus of claim 1, wherein the vibration damping apparatus is adapted to be positioned adjacent to a downhole measurement tool.

15. A vibration damping apparatus comprising:

an annular housing defining a cavity between an internal diameter and an external diameter of the housing, the housing comprising an upper housing, a lower housing, an intermediate housing adapted to connect the upper housing and the lower housing, the upper housing having an extension adapted to pass through the intermediate housing and defining the cavity between the extension and the intermediate housing, and a sleeve adapted to sealingly connect the lower housing and the extension; and a substantially solid vibration damping material disposed in the cavity, the material having a density that is greater than a density of a material from which the housing is formed.

16. The apparatus of claim 15, wherein the vibration damping material comprises crushed tungsten carbide.

17. The apparatus of claim 16, wherein the crushed tungsten carbide has a 30/40 mesh.

18. A vibration damping apparatus comprising:

an annular housing defining a cavity between an internal diameter and an external diameter of the housing; and a substantially solid vibration damping material disposed in the cavity, the material having a density that is greater than a density of a material from which the housing is formed, wherein the vibration damping material comprises a combination of crushed tungsten carbide and lead.

19. The apparatus of claim 18, wherein the combination of crushed tungsten carbide and lead is optimized through laboratory experiment to maximize a vibration absorption capacity of the apparatus.

20. The apparatus of claim 18, wherein the combination of crushed tungsten carbide and lead is optimized through computational modeling to maximize a vibration absorption capacity of the apparatus.

21. A vibration damping apparatus comprising:

an annular housing defining a cavity between an internal diameter and an external diameter of the housing; and a substantially solid vibration damping material disposed in the cavity, the material having a density that is greater than a density of a material from which the housing is formed, wherein the internal diameter and the external diameter of the housing are selected so as to maximize an amount of vibration damping material with respect to a selected tensile strength for the housing.

22. The apparatus of claim 21, wherein the vibration damping material comprises lead.

23. The apparatus of claim 21, wherein the housing material comprises steel.

24. The apparatus of claim 21, wherein the housing material comprises titanium.

25. The apparatus of claim 21, wherein the housing material comprises monel.

26. The apparatus of claim 21, wherein an elastic modulus of the vibration damping material is substantially less than an elastic modulus of the housing material.

27. The apparatus of claim 21, wherein a structural damping coefficient of the vibration damping material is substantially less than a structural damping coefficient of the housing material.

28. A vibration damping apparatus comprising:

an annular housing defining a cavity between an internal diameter and an external diameter of the housing, the housing comprising an upper housing, a lower housing, an intermediate housing adapted to connect the upper housing and the lower housing, the upper housing having an extension adapted to pass through the intermediate housing and defining the cavity between the extension and the intermediate housing, and a sleeve adapted to sealingly connect the lower housing and the extension; and a substantially solid vibration damping material disposed in the cavity, the material having a density that is greater than a density of a material from which the housing is formed, wherein the internal diameter and the external diameter of the housing are selected so as to maximize an amount of vibration damping material with respect to a selected tensile strength for the housing.

29. A vibration damping apparatus comprising:

an annular housing defining a cavity between an internal diameter and an external diameter of the housing; and vibration damping material comprising crushed tungsten carbide disposed in the cavity, the vibration damping material having a density that is greater than a density of a material from which the housing is formed, wherein the internal diameter and the external diameter of the housing are selected so as to maximize an amount of the vibration damping material with respect to a selected tensile strength for the housing.

30. The apparatus of claim 29, wherein the crushed tungsten carbide has a 30/40 mesh.

31. A vibration damping apparatus comprising:

an annular housing defining a cavity between an internal diameter and an external diameter of the housing; and vibration damping material comprising a combination of crushed tungsten carbide and lead disposed in the cavity, the vibration damping material having a density that is greater than a density of a material from which the housing is formed, wherein the internal diameter and the external diameter of the housing are selected so as to maximize an amount of the vibration damping material with respect to a selected tensile strength for the housing.

32. The apparatus of claim 31, wherein the combination of crushed tungsten carbide and lead is optimized through laboratory experiment to maximize a vibration absorption capacity of the apparatus.

33. The apparatus of claim 31, wherein the combination of crushed tungsten carbide and lead is optimized through computational modeling to maximize a vibration absorption capacity of the apparatus.

34. A vibration damping apparatus comprising:

an annular housing defining a cavity between an internal diameter and an external diameter of the housing; and a substantially solid vibration damping material disposed in the cavity, the material having a density that is greater than a density of a material from which the housing is formed, wherein the internal diameter and the external diameter of the housing are selected so as to maximize an amount of vibration damping material with respect to a selected bending strength for the housing.

35. The apparatus of claim 34, wherein the vibration damping material comprises lead.

36. The apparatus of claim 34, wherein the housing material comprises titanium.

37. The apparatus of claim 34, wherein the housing material comprises steel.

38. The apparatus of claim 34, wherein the housing material comprises monel.

39. The apparatus of claim 34, wherein an elastic modulus of the vibration damping material is substantially less than an elastic modulus of the housing material.

40. The apparatus of claim 34, wherein a structural damping coefficient of the vibration damping material is substantially less than a structural damping coefficient of the housing material.

41. A vibration damping apparatus comprising:

an annular housing defining a cavity between an internal diameter and an external diameter of the housing, the housing comprising an upper housing, a lower housing, an intermediate housing adapted to connect the upper housing and the lower housing, the upper housing having an extension adapted to pass through the intermediate housing and defining the cavity between the extension and the intermediate housing, and a sleeve adapted to sealingly connect the lower housing and the extension; and a substantially solid vibration damping material disposed in the cavity, the material having a density that is greater than a density of a material from which the housing is formed, wherein the internal diameter and the external diameter of the housing are selected so as to maximize an amount of vibration damping material with respect to a selected tensile strength for the housing.

42. A vibration damping apparatus comprising:

an annular housing defining a cavity between an internal diameter and an external diameter of the housing; and vibration damping material comprising crushed tungsten carbide disposed in the cavity, the vibration damping material having a density that is greater than a density of a material from which the housing is formed, wherein the internal diameter and the external diameter of the housing are selected so as to maximize an amount of the vibration damping material with respect to a selected bending strength for the housing.

43. The apparatus of claim 42, wherein the crushed tungsten carbide has a 30/40 mesh.

44. A vibration damping apparatus comprising:

an annular housing defining a cavity between an internal diameter and an external diameter of the housing; and vibration damping material comprising a combination of crushed tungsten carbide and lead disposed in the cavity, the vibration damping material having a density that is greater than a density of a material from which the housing is formed, wherein the internal diameter and the external diameter of the housing are selected so as to maximize an amount of the vibration damping material with respect to a selected bending strength for the housing.

45. The apparatus of claim 44, wherein the combination of crushed tungsten carbide and lead is optimized through laboratory experiment to maximize a vibration absorption capacity of the apparatus.

46. The apparatus of claim 44, wherein the combination of crushed tungsten carbide and lead is optimized through computational modeling to maximize a vibration absorption capacity of the apparatus.

* * * * *